US010670014B2

(12) United States Patent
Boeckx et al.

(10) Patent No.: US 10,670,014 B2
(45) Date of Patent: Jun. 2, 2020

(54) OIL-INJECTED VACUUM PUMP ELEMENT

(71) Applicant: ATLAS COPCO AIRPOWER, NAAMLOZE VENNOOTSCHAP, Wilrijk (BE)

(72) Inventors: Jens Boeckx, Wilrijk (BE); Jozef Maria Segers, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 292 days.

(21) Appl. No.: 15/542,326

(22) PCT Filed: Jan. 7, 2016

(86) PCT No.: PCT/BE2016/000002

§ 371 (c)(1),
(2) Date: Jul. 7, 2017

(87) PCT Pub. No.: WO2016/112439

PCT Pub. Date: Jul. 21, 2016

(65) Prior Publication Data

US 2018/0274541 A1 Sep. 27, 2018

Related U.S. Application Data

(60) Provisional application No. 62/103,772, filed on Jan. 15, 2015.

(30) Foreign Application Priority Data

Mar. 12, 2015 (BE) ..... 2015/5137

(51) Int. Cl.

| | |
|---|---|
| ***F04C 18/08*** | (2006.01) |
| ***F04C 18/16*** | (2006.01) |
| ***F04C 29/00*** | (2006.01) |

(52) U.S. Cl.
CPC ..... *F04C 18/088* (2013.01); *F04C 18/16* (2013.01); *F04C 29/0007* (2013.01); *F04C 2220/10* (2013.01); *F04C 2240/30* (2013.01)

(58) Field of Classification Search
CPC ..... F04C 18/088; F04C 29/0007
See application file for complete search history.

(56) References Cited

U.S. PATENT DOCUMENTS 3,423,017 A * 1/1969 Schibbye ..... F04C 18/084 418/201.3
3,677,664 A 7/1972 Wycliffe et al.
(Continued)

FOREIGN PATENT DOCUMENTS

JP S5424307 A 2/1979
JP S61123793 A 6/1986
(Continued)

OTHER PUBLICATIONS

International Search Report (ISR) dated May 19, 2016, for PCT/BE2016/000002.

*Primary Examiner* — Mary Davis
(74) *Attorney, Agent, or Firm* — Bacon & Thomas, PLLC

(57) ABSTRACT

An oil-injected vacuum pump element, where two mating helical rotors are rotatably provided in a housing, where this housing includes an inlet port and an outlet end face with an outlet port, where compression chambers are formed between the helical rotors and the housing. The vacuum pump element is provided with a connection that extends from a first compression chamber to a second smaller compression chamber at the outlet end face, where this first compression chamber is at a lower pressure than the second compression chamber and where this second compression chamber can make connection with the outlet port upon rotation of the helical rotors, where the connection is such that a flow from the second compression chamber to the first
(Continued)

compression chamber is possible, where the connection is not directly connected to the outlet port.

8 Claims, 4 Drawing Sheets

(56) References Cited

U.S. PATENT DOCUMENTS

| | | | | |
|---|---|---|---|---|
| 4,560,333 | A * | 12/1985 | Fujiwara | F04C 18/088 418/180 |
| 5,002,472 | A | 3/1991 | Helliot et al. | |
| 2008/0080997 | A1 † | 4/2008 | Fujiwara | |

FOREIGN PATENT DOCUMENTS

| | | | |
|---|---|---|---|
| JP | S63248982 | A | 10/1988 |
| WO | 89/12752 | A1 | 12/1989 |
| WO | 2006/095364 | A1 | 9/2006 |

* cited by examiner
† cited by third party

OIL-INJECTED VACUUM PUMP ELEMENT

The present invention relates to an oil-injected vacuum pump element.

More specifically, the invention is intended for oil-injected vacuum pump elements of the screw type, whereby two mating helical rotors are rotatably provided in a housing.

BACKGROUND OF THE INVENTION

Chambers are defined between the lobes of the helical rotors and the walls of the housing, that move from the inlet side to the outlet side as a result of the rotation of the rotors and thereby become increasingly smaller so that the air trapped in these chambers is compressed.

It is known that oil is injected into the compression chamber of such elements to remove the heat of compression, to lubricate the helical rotors, to prevent corrosion and to ensure a seal between the rotors.

This oil originates from an oil separator where the oil is separated from the outlet air.

It is impossible for all air to be removed from the oil, so that oil is injected that contains a certain amount of air.

This air content can be in the oil in the form of air bubbles or dissolved therein.

As a result there is a risk of cavitation. In an oil flow there are two types of cavitation:

- cavitation whereby oil vapour bubbles are formed because the static pressure falls below the vapour pressure of the oil;
- cavitation whereby air bubbles are formed in oil flows that contain a certain quantity of air, because a reduction of the static pressure makes the solubility of air in the oil fall.

Depending on the type of cavitation, damage can occur when the air bubbles or oil vapour bubbles thus formed implode in the vicinity of (metal) components. This damage can be very extensive and can lead to the destruction of the machine.

Such cavitation can occur in an oil-injected vacuum pump element of the screw type under the influence of a fall of the static pressure, more specifically at the outlet of the vacuum pump in the last phase of compression.

In the last phase of compression, the volume of the compression chamber goes to zero, such that the pressure in this chamber can rise above the outlet pressure. As a result, large pressure differences occur between the aforementioned chamber and the inlet, where the pressure can be 0.3 mbar(a) and below.

During the last compression phase, the aforementioned chamber is separated from another compression chamber that connects to the inlet by only one single section of the rotor profiles.

In this section a type of channel forms between the profiles of the rotors or between the rotors and the outlet end face that first converges and then diverges to form a 'nozzle'.

A leakage flow of gas and oil is possible through this channel from the aforementioned chamber to the inlet due to the large pressure difference between the two, whereby due to the form of the channel and the rotors the speed of this leakage flow becomes so high that the static pressure becomes so low that gas bubbles can form.

Further in the channel the static pressure again increases, such that the bubbles formed implode, such that damage occurs to the rotors and the housing. As a result of this damage the vacuum pump element will no longer function or will do so less well.

SUMMARY OF THE INVENTION

The purpose of the present invention is to provide a solution to the aforementioned and other disadvantages.

The subject of the present invention is an oil-injected vacuum pump element of the screw type, whereby two mating helical rotors are rotatably provided in a housing, whereby this housing comprises an inlet port, an inlet end face and an outlet end face with an outlet port, whereby compression chambers are formed between the helical rotors and the housing that proceed from the inlet port to the outlet port due to the rotation of the helical rotors and thereby become increasingly smaller, whereby the oil-injected vacuum pump element is provided with a connection that extends from a first compression chamber to a second smaller compression chamber at the outlet end face, whereby this first compression chamber is at a lower pressure than the second compression chamber and whereby this second compression chamber can make connection with the outlet port upon rotation of the helical rotors, whereby the connection is such that a flow from the second compression chamber to the first compression chamber is possible so that the pressure in the second compression chamber is reduced, whereby the connection is not directly connected to the outlet port.

Due to the rotation of the helical rotors the first compression chamber will become increasingly smaller and finally becomes the second compression chamber, whereby at this time a new first compression chamber is formed.

The second compression chamber is the compression chamber at the end of the compression cycle, in which there is compressed gas that can then leave the vacuum pump element via the outlet port. It goes without saying that this second compression chamber is not connected to the inlet port.

An advantage of an oil-injected vacuum pump element according to the invention is that the pressure difference between the inlet and the second compression chamber is reduced because a flow of gas and oil is made possible via the connection from the second compression chamber at a higher pressure to the first compression chamber at a lower pressure.

As a result cavitation can be prevented because the flow via the channel between the profiles of the helical rotors or the flow between the rotors and the outlet end face in the section of the rotor profiles that separates the aforementioned second compression chamber from the compression chamber that is connected to the inlet, will have a much lower speed.

Indeed, due to the reduced pressure in the second compression chamber, the pressure difference across the aforementioned channel is too small to cause a flow through the channel that can give rise to cavitation.

The precise location of the connection and the design thereof will depend on the profile of the helical rotors and the shape and location of the outlet port. Both can differ strongly depending on the vacuum pump element concerned.

In each case it must be prevented that the connection comes into contact with the outlet port, i.e. the connection must not connect directly to the outlet port.

BRIEF DESCRIPTION OF THE DRAWINGS

With the intention of better showing the characteristics of the invention, a few preferred embodiments of an oil-injected vacuum pump element according to the invention are described hereinafter by way of an example, without any limiting nature, with reference to the accompanying drawings, wherein.

DETAILED DESCRIPTION OF THE INVENTION

Figure 1:
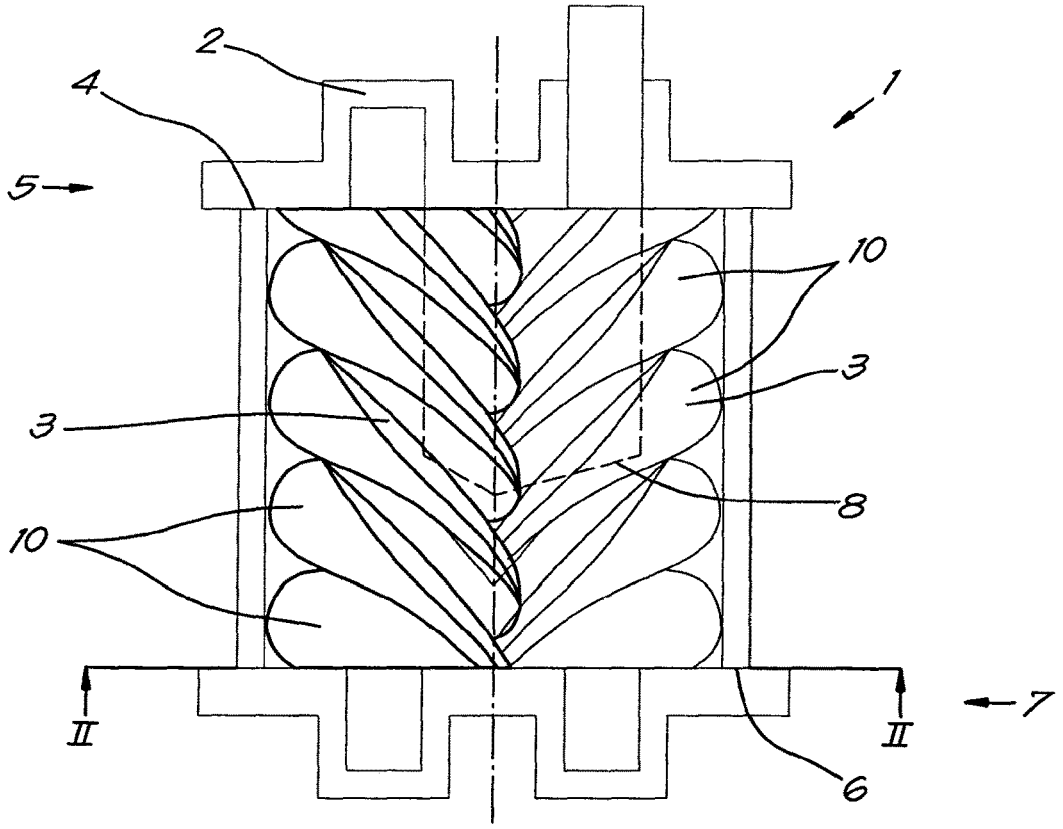
FIG. 1 schematically shows an oil-injected vacuum pump element of the screw type.

The oil-injected vacuum pump element 1 shown in FIG. 1 is an element of the screw type.

The element 1 essentially comprises a housing 2 in which two mating helical rotors 3 are rotatably provided.

The housing 2 comprises an inlet end face 4 on the inlet side 5 and an outlet end face 6 on the outlet side 7.

An inlet port 8 is affixed in the housing 2. This inlet port 8 is indicated by a dashed line in FIG. 1.

Figure 2:
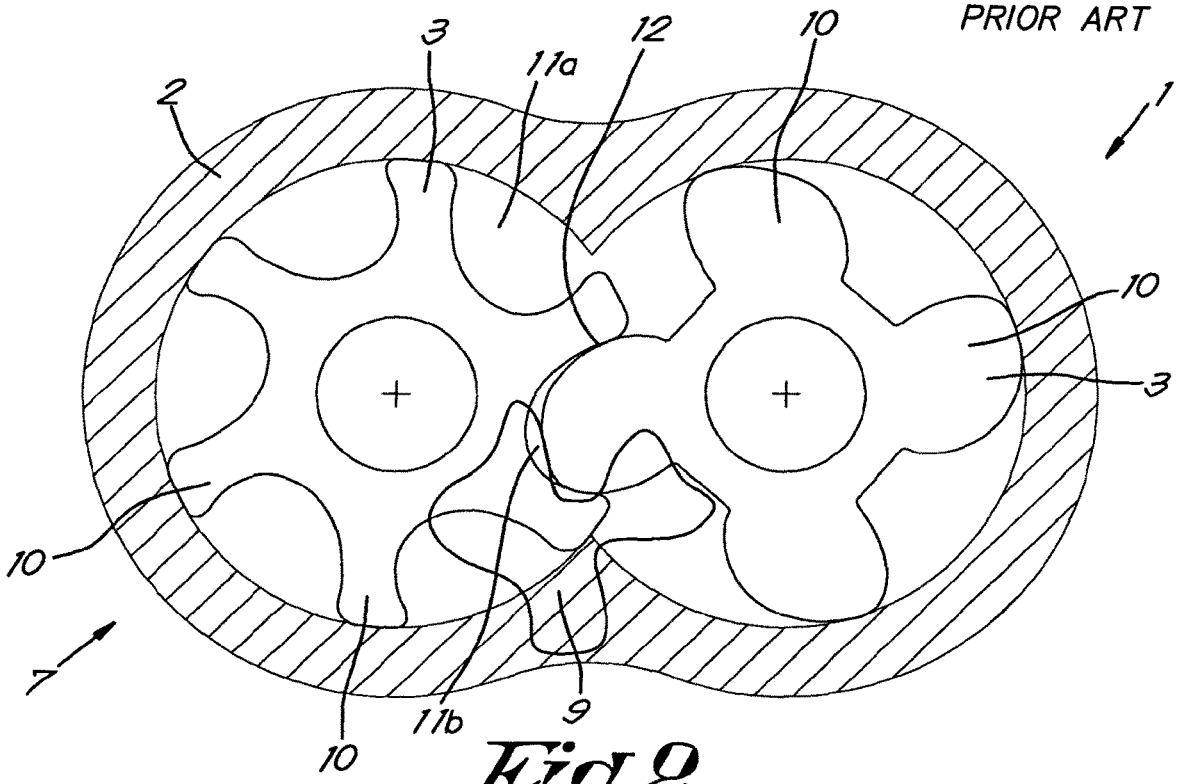
FIG. 2 schematically shows a cross-section of the oil-injected vacuum pump element of FIG. 1 along the line II-II of FIG. 1.

An outlet port 9 is affixed in the housing at the location of the outlet end face 6. This is shown in FIG. 2.

Compression chambers 11*a*, 11*b* are formed between the lobes 10 of the helical rotors 3 and the housing 2. Due to the rotation of the helical rotors 3 these compression chambers 11*a*, 11*b* move from the inlet port 8 to the outlet port 9.

For as long as the compression chamber 11*a*, 11*b* makes contact with the inlet port 8, its volume will increase, so that a suction of gas is created.

When the compression chamber 11*a*, 11*b* is no longer in contact with the inlet port 8, the volume of the compression chambers 11*a*, 11*b* will decrease upon further rotation of the helical rotors 3 so that the gas, for example air, is compressed in these chambers.

Air that gets into a compression chamber 11*a* via the inlet port 8 in the first compression phase is transported to the outlet port 9 by the rotation of the helical rotors 3 and is thereby compressed to a higher pressure.

At a certain time during the rotation of the helical rotors 3 the compression chamber 11*b* will make contact with the outlet port 9 so that the compressed air in this compression chamber 11*b* can be removed during the last compression phase.

The accompanying compression chambers 11*a*, 11*b* that belong to the two aforementioned compression phases, i.e. a first compression chamber 11*a* that makes contact with the inlet port 8 and the outlet end face 6 and a second compression chamber 11*b* that only makes contact with the outlet end face 6 but not with the inlet port 8 or the inlet end face 4, are indicated in FIG. 2.

As can be seen in this drawing these two compression chambers 11*a*, 11*b* are separated from one another by one single section of the helical rotors 3, whereby a channel 12 with a "nozzle" shape is formed between the profiles of the helical rotors 3.

A flow of air and/or oil is possible via this channel 12 in the direction from the second compression chamber 11*b* to the first compression chamber 11*a*, whereby due to the form of the channel 12 the flow speed becomes so high that cavitation can occur.

Figure 3:
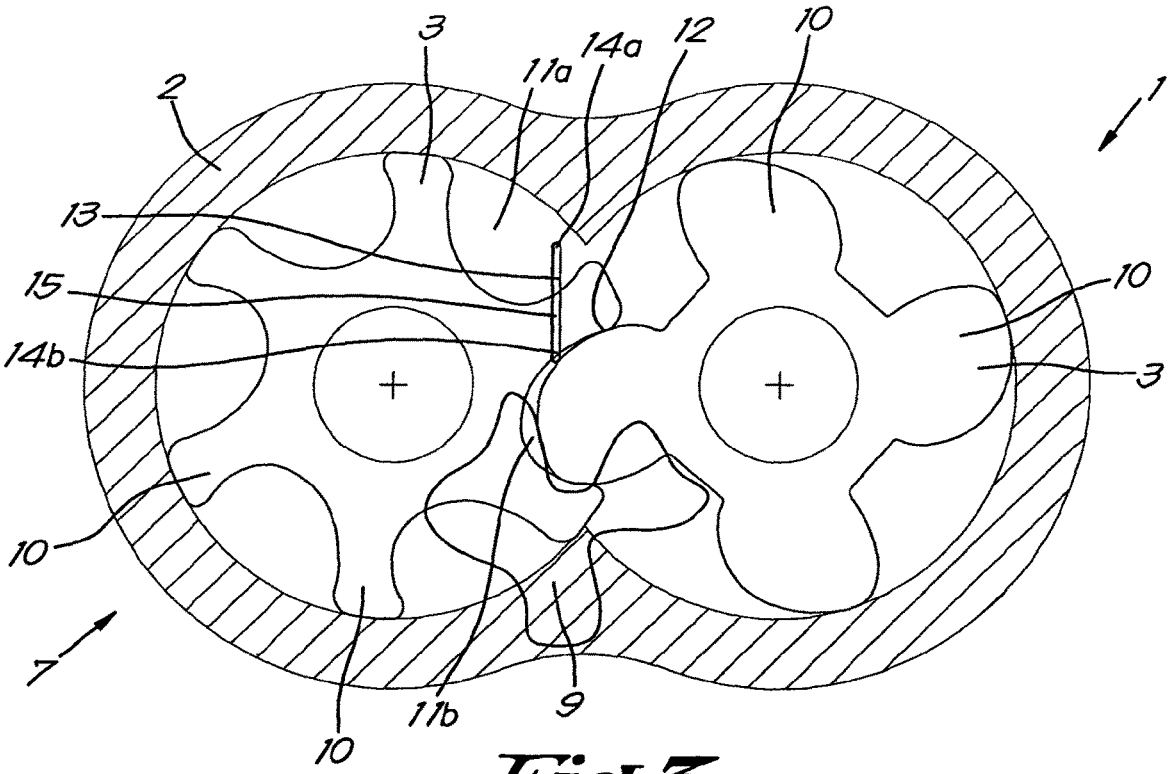
FIG. 3 shows a similar cross-section to FIG. 2, but of an oil-injected vacuum pump element according to the invention.

In an oil-injected vacuum pump element 1 according to the invention, as shown in FIG. 3, a connection is affixed in the outlet end face, in this case in the form of a groove 13.

This groove 13 extends from the first compression chamber 11*a* to the second compression chamber 11*b*.

Hereby a first end 14*a* of the groove 13 will at least partially overlap the first compression chamber 11*a* and a second end 14*b* of the groove 13 will overlap the second compression chamber 11*b*.

A flow of gas and/or oil from the second chamber 11*b*, at a higher pressure, is possible via this groove 13 to the first compression chamber 11*a* so that the pressure in the second compression chamber 11*b* is reduced.

In this way the pressure in the second compression chamber 11*b* can be prevented from becoming too high such that the flow of gas and/or oil will be slower via the aforementioned channel 12.

In this way cavitation, and the detrimental consequences thereof, is prevented.

Although in the example shown the groove 13 makes contact with a first compression chamber 11*a* that is connected to the inlet port 8, this is not necessarily the case. It is only necessary for the invention that the first compression chamber 11*a* concerned, to which the groove 13 is connected, is at a lower pressure than the second compression chamber 11*b*.

According to the invention the connection is designed such that the groove 13 is not directly connected to the outlet port 9.

This can clearly be seen in FIG. 3: the groove 13 stops at some distance from the outlet port 9 so that there is no contact with the second end 14*b* of the groove 13 and the outlet port 9.

This will ensure that a direct leakage flow is not possible from the outlet port 9 to the inlet port 8 via the groove 13 and the first compression chamber 11*a*, whereby this leakage flow negatively affects the efficiency of the oil-injected vacuum pump element 1.

In the situation of FIG. 3 the second end 14*b* of the groove 13 is not in contact with the second compression chamber 11*b*. Upon further rotation of the helical rotors 3, whereby the second compression chamber 11*b* becomes increasingly smaller, this end 14*b* will increasingly overlap the second compression chamber 11*b*. As a result, the pressure increase in the second compression chamber 11*b* will be counteracted, because this chamber is still in contact with the first compression chamber 11*a* by means of the groove 13, so that a flow of gas and/or oil is possible from the second compression chamber 11*b* to the first compression chamber 11*a*.

Figure 4:
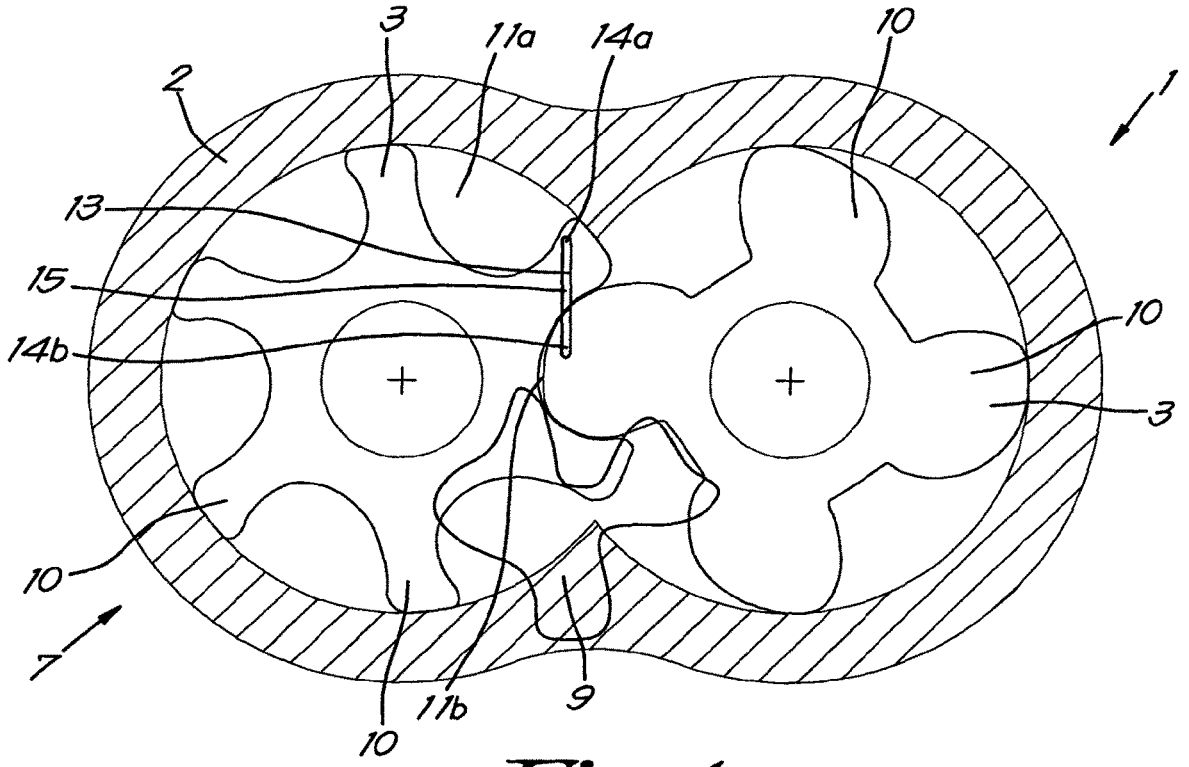
FIG. 4 shows the cross-section of FIG. 3, but in a different position of the helical rotors.
Figure 5:
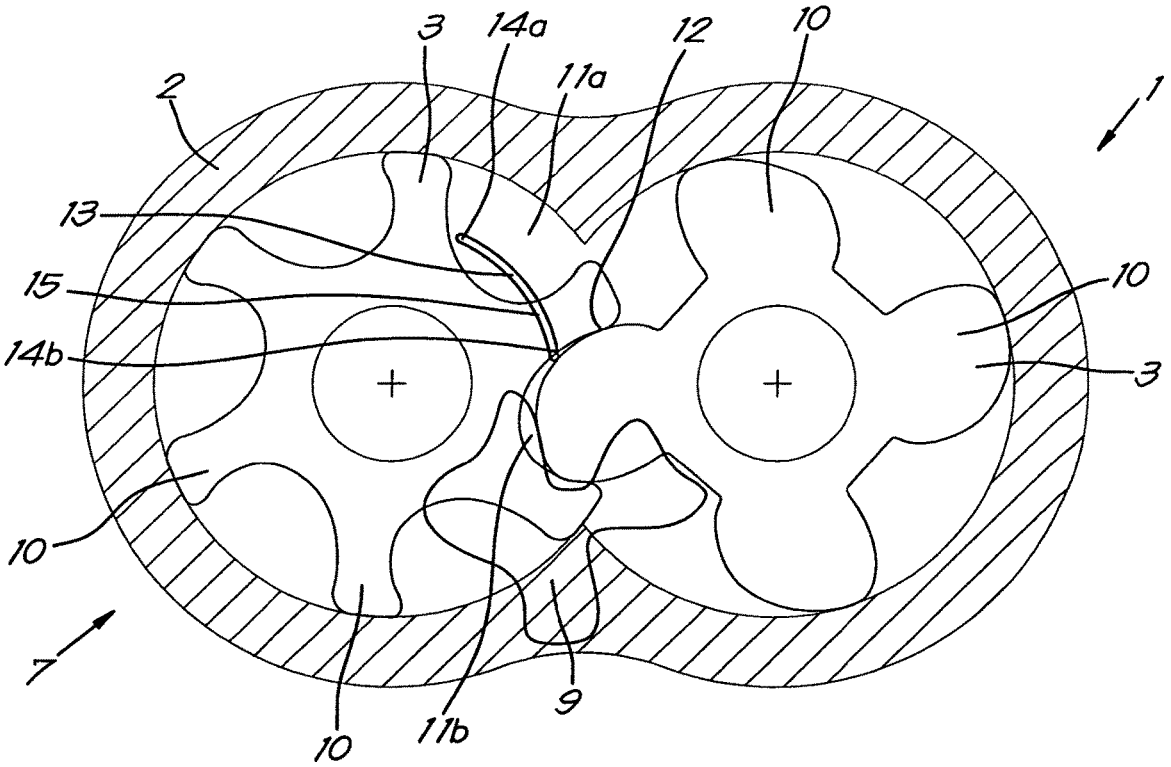
FIGS. 5 to 7 show alternative embodiments of FIG. 3.
Figure 6:
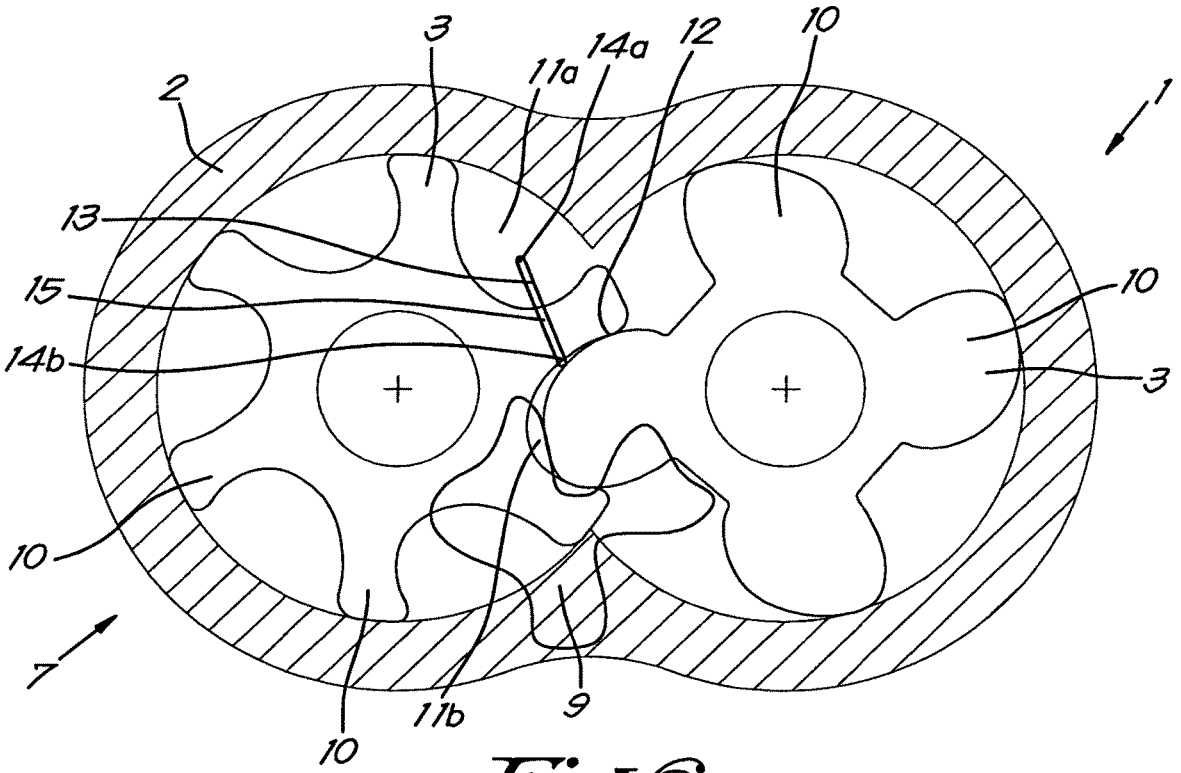

FIG. 4 shows the situation whereby the volume of the second compression chamber 11*b* has gone to practically zero. Hereby the second end 14*b* of the groove 13 is still connected to the second compression chamber 11*b*.

At this moment the pressure in the second compression chamber 11*b* can become very high, but the pressure in the second compression chamber 11*b* will be low enough to prevent cavitation through the connection to the first compression chamber 11*a* by means of the groove 13.

The location of the second end 14*b*, by which the groove 13 makes contact with the second compression chamber 11*b*, must be suitably chosen such that a connection to the second compression chamber 11*b* is realised without coming into contact with the outlet port 9.

The final location of the groove 13, and in particular the second end 14*b*, will depend on the rotor profiles and the shape of the outlet port 9.

The final form and size of the groove 13 and thus the flow rate of gas and/or oil that can flow via the groove 13 will depend on two criteria:

- the flow rate must be high enough so that the pressure in the second compression chamber 11*b* can fall enough to prevent cavitation;
- the flow rate may not be too high because in this case the performance or efficiency of the oil-injected vacuum pump element 1 will fall.

The flow rate that can flow via the groove 13 will depend on the cross-sectional area of the groove 13.

Preferably this cross-sectional area of the groove 13 in $mm^2$ allows for a flow between 0.01 and 0.04 times the maximum volumetric flow of the oil-injected vacuum pump element 1 in litres per second.

However, it is not excluded that this cross-sectional area in $mm^2$ allows for a flow between 0.01 and 0.1 or 0.01 and 0.08 or 0.01 and 0.06 times the maximum volumetric flow of the oil-injected vacuum pump element 1 in litres per second.

A groove 13 with a smaller cross-sectional area will not be able to allow sufficient flow to let the pressure in the second compression chamber 11*b* fall enough to prevent cavitation.

A groove 13 with a larger cross-sectional area will allow through the large flows from the second compression chamber 11*b* to the first compression chamber 11*a*, such that the efficiency of the oil-injected vacuum pump element 1 will fall by too much.

Preferably the end 14*b* of the groove 13 that is connected to the second compression chamber 11*b* at the outlet end face 6 is designed such that the contact area between the groove and the aforementioned compression chamber 11*b* has an area in $mm^2$ that allows for a flow between 0.01 and 0.04 times the maximum volumetric flow of the oil-injected vacuum pump element 1 in litres per second.

It is not excluded that the aforementioned contact area allows for a flow between 0.01 and 0.1 or 0.01 and 0.08 or 0.01 and 0.06 times the maximum volumetric flow of the oil-injected vacuum pump element 1 in litres per second.

As it is possible that the contact area between the groove 13 and the second compression chamber 11*b* is less than the cross-section of the groove 13 itself, preferably it is sufficient for the aforementioned contact area to be at the higher stated condition, in order to obtain the desired effect.

Different options are possible with regard to the final design of the groove 13.

Preferably the groove comprises at least one slot-shaped section 15.

Slot-shaped 15 section here means a part of the groove 13 whose cross-section, viewed in the flow direction through the groove 13, does not change or practically does not change.

This section 15 can be straight or curved.

In FIGS. 3 to 6 the groove 13 only comprises a slot-shaped section 15.

As can be seen in these drawings, the slot-shaped groove 13 has different orientations.

It is also possible that the groove 13 connecting to this slot-shaped section 15 comprises a broadened section 16, whereby the groove 13 at least partially overlaps the first compression chamber 11*a*.

Figure 7:
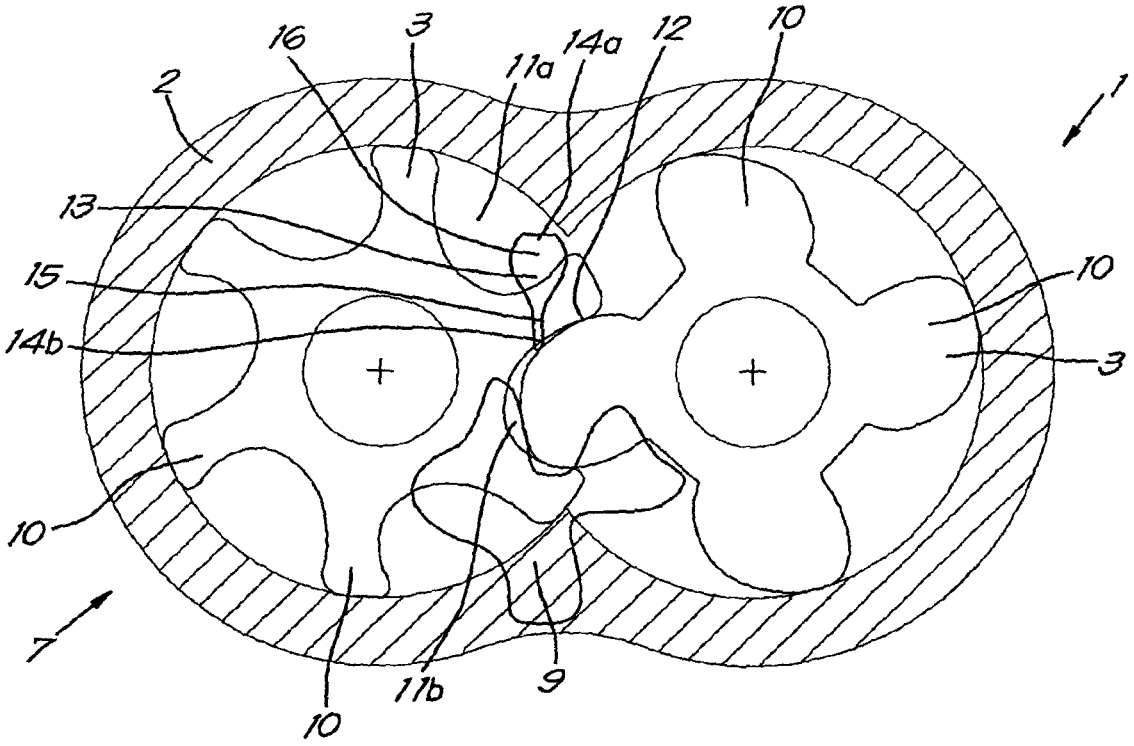

This is shown in FIG. 7, where it can be seen that the first end 14*a* of the groove 13 is formed by a broadened section 16 with a wider cross-section than the second end 14*b* that is formed by a slot-shaped section 15.

The precise shape of this broadened section 16 is of secondary importance.

The only condition for the first end 14*a* is that this end 14*a* extends far enough so that the groove 13 is always connected to the first compression chamber 11*a*.

Preferably the overlap between the groove 13 and the first compression chamber 11*a* is such that the connection between the first compression chamber 11*a* and the second compression chamber 11*b* is preserved by means of the groove 13 upon the rotation of the helical rotors 2 until the volume of the second compression chamber 11*b* goes to zero.

At this moment the pressure in the second compression chamber 11*b* is very high and the second compression chamber 11*b* is no longer connected to the outlet port 9, such that the high pressure in this second compression chamber 11*b* can only escape via the aforementioned nozzle-shaped channel 12.

In order to prevent this it is ensured that the second compression chamber 11*b* is connected to the first compression chamber 11*a*, and thus the inlet port 8, by means of the groove 13.

In this way the pressure in the second compression chamber 11*b* can be prevented from becoming too high during this phase at the time that the volume in this compression chamber 11*b* goes to zero and cavitation can be prevented.

Although in the examples shown above, the connection is always made by means of a groove 13 in the outlet end face 6, it is not excluded that the connection is realised by means of a groove part in the outlet end face 6 that at least partially overlaps the second compression chamber 11*b* and a channel or pipe connected thereto that leads to a first compression chamber 11*a* at a lower pressure than the second compression chamber 11*b*.

As already stated, this compression chamber 11*a* can be the compression chamber 11*a* that is connected to the inlet port 8, but this is not the necessary for the invention.

This channel or this pipe can be built in housing itself or otherwise, but of course can also be constructed on the housing.

In such an embodiment, preferably it must be ensured that the cross-sectional area of the groove part and the channel and the contact area between the groove part and the second compression chamber 11*b* both satisfy the above-mentioned conditions, i.e. this cross-sectional area and this contact area in $mm^2$ allowing for a flow between 0.01 and 0.1 times the maximum volumetric flow of the oil-injected vacuum pump element 1 in litres per second, and preferably between 0.01 and 0.08 times, even better between 0.01 and 0.06 times, and even more preferably between 0.01 and 0.04 times.

The aforementioned groove part can take on the form of the slot-shaped section 15 of the groove 13 for example, as shown in FIG. 7.

Preferably it is also ensured that the channel or the pipe is such that the connection between the first compression chamber 11*a* and the channel or the pipe is preserved upon rotation of the helical rotors 3 until the volume of the second compression chamber 11*b* goes to zero.

The present invention is by no means limited to the embodiments described as an example and shown in the drawings, but an oil-injected vacuum pump element according to the invention can be realised in all kinds of forms and dimensions without departing from the scope of the invention.

The invention claimed is:

1. An oil-injected vacuum pump element comprising:

two mating helical rotors rotatably provided in a housing, said housing comprising an inlet port, an inlet end face and an outlet end face with an outlet port;

compression chambers comprising at least a first compression chamber and a second smaller compression chamber, said compression chambers formed between the helical rotors and the housing that proceed from the inlet port to the outlet port due to the rotation of the helical rotors and thereby become increasingly smaller;

a connection that extends from the first compression chamber to the second smaller compression chamber at the outlet end face, wherein said first compression chamber is at a lower pressure than the second compression chamber and wherein said second compression chamber is configured to connect with the outlet port upon rotation of the helical rotors, wherein the connection is a groove affixed in the outlet end face, wherein said groove extends from the first compression chamber to the second compression chamber such that a flow from the second compression chamber to the first compression chamber is possible so that the pressure in the second compression chamber is reduced, wherein the connection is not directly connected to the outlet port, wherein the groove at least comprises a slot-shaped straight or curved section, wherein an end of the connection that is connected to the second compression chamber at the outlet end face is designed such that a contact area between the connection and the aforementioned second compression chamber has an area in $mm^2$ that allows for a flow of between 0.01 and 0.1 times the maximum volumetric flow of the oil-injected vacuum pump element in liters per second.

2. The oil-injected vacuum pump element according to claim 1, wherein the first compression chamber makes contact with the inlet port and with the outlet end face.

3. The oil-injected vacuum pump element according to claim 1, wherein next to the aforementioned slot-shaped section, the groove comprises a broadened section with which the groove at least partially overlaps the first compression chamber.

4. The oil-injected vacuum pump element according to claim 1, wherein the connection has a cross-sectional area in $mm^2$ that allows for the flow between 0.01 and 0.1 times the maximum volumetric flow of the oil-injected vacuum pump element in liters per second.

5. The oil-injected vacuum pump element according to claim 1, wherein the overlap between the connection and the first compression chamber is such that the connection between the first compression chamber and the second compression chamber is preserved upon rotation of the helical rotors until the volume of the second compression chamber goes to zero or practically zero.

6. The oil-injected vacuum pump element according to claim 1, wherein the connection has a cross-sectional area in $mm^2$ that allows for the flow between 0.01 and 0.04 times the maximum volumetric flow of the oil-injected vacuum pump element in liters per second.

7. The oil-injected vacuum pump element according to claim 1, wherein the end of the connection that is connected to the second compression chamber at the outlet end face is designed such that the contact area between the connection and the aforementioned second compression chamber has an area in $mm^2$ that allows for the flow of between 0.01 and 0.04 times the maximum volumetric flow of the oil-injected vacuum pump element in liters per second.

8. An oil-injected vacuum pump element comprising:

a housing, two mating helical rotors rotatable in said housing, an inlet face in said housing, an inlet port in said inlet face, an outlet face in said housing, an outlet port in said outlet face, a first compression chamber formed between the helical rotors and the housing, a second compression chamber formed between the helical rotors and the housing, and said second compression chamber is configured to connect with the outlet port upon rotation of the helical rotors, a groove in the outlet face that connects the first compression chamber to the second compression chamber, and said groove is not directly connected to said outlet port, a first end of the groove that is always connected to the first compression chamber, and a second end of the groove that overlaps the second compression chamber, wherein a cross-sectional area of the groove in $mm^2$ is configured to allow for a flow between 0.01 and 0.1 times the maximum volumetric flow of the oil-injected vacuum pump element in liters per second.

* * * * *